US010161686B2

(12) United States Patent
Taras

(10) Patent No.: US 10,161,686 B2
(45) Date of Patent: Dec. 25, 2018

(54) MICROCHANEL HEAT EXCHANGER EVAPORATOR

(71) Applicant: Carrier Corporation, Jupiter, FL (US)

(72) Inventor: Michael F. Taras, Syracuse, NY (US)

(73) Assignee: CARRIER CORPORATION, Farmington, CT (US)

( * ) Notice: Subject to any disclaimer, the term of this patent is extended or adjusted under 35 U.S.C. 154(b) by 0 days.

(21) Appl. No.: 15/126,934

(22) PCT Filed: Mar. 12, 2015

(86) PCT No.: PCT/US2015/020161
§ 371 (c)(1),
(2) Date: Sep. 16, 2016

(87) PCT Pub. No.: WO2015/142615
PCT Pub. Date: Sep. 24, 2015

(65) Prior Publication Data

US 2017/0089642 A1 Mar. 30, 2017

Related U.S. Application Data

(60) Provisional application No. 61/954,868, filed on Mar. 18, 2014.

(51) Int. Cl.
*F28F 9/02* (2006.01)
*F28D 1/053* (2006.01)
(Continued)

(52) U.S. Cl.
CPC ..... *F28D 1/05391* (2013.01); *F28F 1/126* (2013.01); *F28F 9/0209* (2013.01);
(Continued)

(58) Field of Classification Search
CPC ..... F28F 1/126; F28F 9/0209; F28F 9/0273; F28F 2260/02; F25B 39/00; F25B 39/02;
(Continued)

(56) References Cited

U.S. PATENT DOCUMENTS 3,976,128 A 8/1976 Patel et al.
5,582,239 A 12/1996 Tsunoda et al.
(Continued)

FOREIGN PATENT DOCUMENTS

CN 101782298 A 7/2010
EP 1643202 A1 4/2006
(Continued)

OTHER PUBLICATIONS

International Search Report and Written Opinion for Application No. PCT/US 2015/020161 dated May 22, 2015; 9 pgs.
(Continued)

*Primary Examiner* — Davis Hwu
(74) *Attorney, Agent, or Firm* — Cantor Colburn LLP

(57) ABSTRACT

An evaporator heat exchanger includes a first tube bank having an inlet manifold and a plurality of first heat exchanger tubes arranged in a spaced, parallel relationship. A second tube bank includes an outlet manifold and a plurality of second heat exchanger tubes arranged in a spaced, parallel relationship. An intermediate manifold fluidly coupled the first tube bank and the second tube bank. A distributor insert arranged within the inlet manifold includes a first dividing element configured to define a plurality of first refrigerant chambers therein. A second dividing element is arranged within the intermediate manifold and is configured to define a plurality of second refrigerant chamber therein. Each second dividing element is arranged at a position substantially identical to a corresponding first dividing element. Each second refrigerant chamber is fluidly coupled to the same portion of the first heat exchanger tubes and a corresponding first refrigerant chamber.

15 Claims, 9 Drawing Sheets

(51) Int. Cl.
*F25B 39/02* (2006.01)
*F28F 1/12* (2006.01)
*F25B 39/00* (2006.01)

(52) U.S. Cl.
CPC ..... *F28F 9/0273* (2013.01); *F25B 39/00* (2013.01); *F25B 39/02* (2013.01); *F28F 1/128* (2013.01); *F28F 2260/02* (2013.01)

(58) Field of Classification Search
CPC ... F25B 39/028; F21C 37/151; F28D 1/05391
USPC ..... 165/174
See application file for complete search history.

(56) References Cited

U.S. PATENT DOCUMENTS

| | | | |
|---|---|---|---|
| 5,765,393 | A | 6/1998 | Shlak et al. |
| 5,901,785 | A | 5/1999 | Chiba |
| 6,125,927 | A | 10/2000 | Hubert |
| 6,199,401 | B1 | 3/2001 | Haussmann |
| 6,394,176 | B1 | 5/2002 | Marsais |
| 6,484,797 | B2 | 11/2002 | Saito et al. |
| 7,036,571 | B2 | 5/2006 | Kamiyama |
| 8,113,270 | B2 | 2/2012 | Rios et al. |
| 8,225,853 | B2 | 7/2012 | Macri et al. |
| 2006/0054310 | A1 | 3/2006 | Kim et al. |
| 2010/0031698 | A1* | 2/2010 | Higashiyama ..... F25B 39/028 62/525 |
| 2010/0095688 | A1* | 4/2010 | Taras ..... F25B 39/00 62/115 |
| 2011/0315364 | A1* | 12/2011 | Matter, III ..... B21C 37/151 165/177 |
| 2013/0160981 | A1 | 6/2013 | Wang et al. |

FOREIGN PATENT DOCUMENTS

| | | | |
|---|---|---|---|
| EP | 1558887 | B1 | 7/2008 |
| EP | 2581696 | A1 | 4/2013 |
| GB | 2250336 | A | 6/1992 |
| JP | H06159983 | A | 6/1994 |
| JP | H06194003 | A | 7/1994 |
| WO | 2009048451 | A1 | 4/2009 |

OTHER PUBLICATIONS

PCT International Preliminary Report on Patentability (IPRP); International Application No. PCT/US2015/020161; International Filing Date: Mar. 12, 2015, dated Sep. 20, 2016; pp. 1-6.
First Office Action issued in Chinese Patent Application No. 201580014875 dated Apr. 3, 2018, 55 pages.

* cited by examiner

MICROCHANEL HEAT EXCHANGER EVAPORATOR

This application is a National Phase Application of Patent Application PCT/US2015/020161 filed on Mar. 12, 2015, which claims benefit of U.S. Provisional Application No. 61/954,868 filed Mar. 18, 2014, the contents of which are incorporated herein by reference in their entirety.

CROSS-REFERENCE TO RELATED APPLICATIONS

This application is related to U.S. patent application Ser. No. 12/921,414 filed Apr. 13, 2009, the entire contents of which are incorporated herein by reference.

BACKGROUND

This invention relates generally to heat exchangers and, more particularly, to microchannel heat exchangers for use in air conditioning and refrigeration vapor compression systems.

Refrigerant vapor compression systems are well known in the art and are commonly used for conditioning air to be supplied to a climate controlled comfort zone within a residence, office building, hospital, school, restaurant, or other facility. A conventional refrigerant vapor compression system 20, as illustrated in FIG. 1, typically includes a compressor 22, a condenser (or gas cooler) 24, an expansion device 26, and an evaporator 28 interconnected by refrigerant lines to form a closed refrigerant circuit. As refrigerant flows through the expansion device 26, the pressure of the refrigerant decreases such that typically 10-20% of the refrigerant vaporizes. If the flash gas or vaporized refrigerant circulates through the evaporator 28 with the liquid refrigerant, the pressure drop in the evaporator 28 increases, thereby decreasing the performance of the vapor compression system 10. In addition, the flow of flash gas through the evaporator 28 results in maldistribution of the refrigerant among the multiple conduits in the evaporator 28, leading to less than optimal utilization of the heat transfer surface thereof.

To maximize the efficiency of the refrigerant vapor system, an external separator is fluidly connected to the closed loop refrigeration circuit downstream from the expansion valve and upstream from the evaporator. The separator divides the 2-phase refrigerant mixture from the expansion device into liquid refrigerant and vaporized refrigerant. The liquid refrigerant is provided to the evaporator, and the flash gas is provided directly to an inlet of the compressor. Bypassing the flash gas around the evaporator can result in capacity and coefficient of performance (COP) improvements of about 20%. The additional components and controls associated with integrating an external separator into the vapor compression system, however, increase both the cost and complexity of the system, essentially nullifying any benefits achieved and making application of an external separator typically impractical.

SUMMARY OF THE INVENTION

An embodiment includes a heat exchanger comprising a first tube bank having an inlet manifold and a plurality of first heat exchanger tubes arranged in a spaced, parallel relationship. A second tube bank includes an outlet manifold and a plurality of second heat exchanger tubes arranged in a spaced, parallel relationship. An intermediate manifold fluidly coupled the first tube bank and the second tube bank. A distributor insert arranged within the inlet manifold includes a first dividing element configured to define a plurality of first refrigerant chambers therein. A second dividing element is arranged within the intermediate manifold and is configured to define a plurality of second refrigerant chamber therein. Each second dividing element is arranged at a position substantially identical to a corresponding first dividing element. Each second refrigerant chamber is fluidly coupled to the same portion of the first heat exchanger tubes and a corresponding first refrigerant chamber.

BRIEF DESCRIPTION OF THE DRAWINGS

The subject matter, which is regarded as the invention, is particularly pointed out and distinctly claimed in the claims at the conclusion of the specification. The foregoing and other features, and advantages of the invention are apparent from the following detailed description taken in conjunction with the accompanying drawings in which:

The detailed description explains embodiments of the invention, together with advantages and features, by way of example with reference to the drawings.

DETAILED DESCRIPTION

Figure 1:
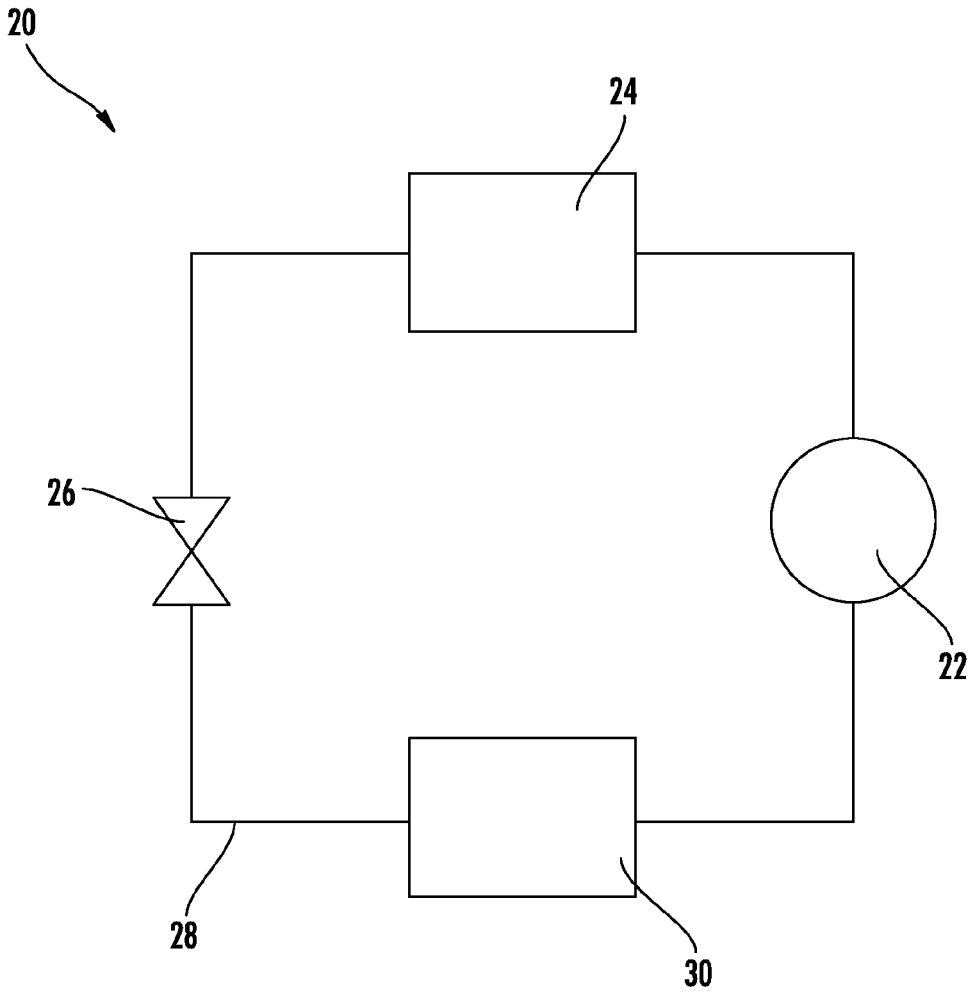
FIG. 1 is an example of a conventional vapor compression refrigeration system.
Figure 2:
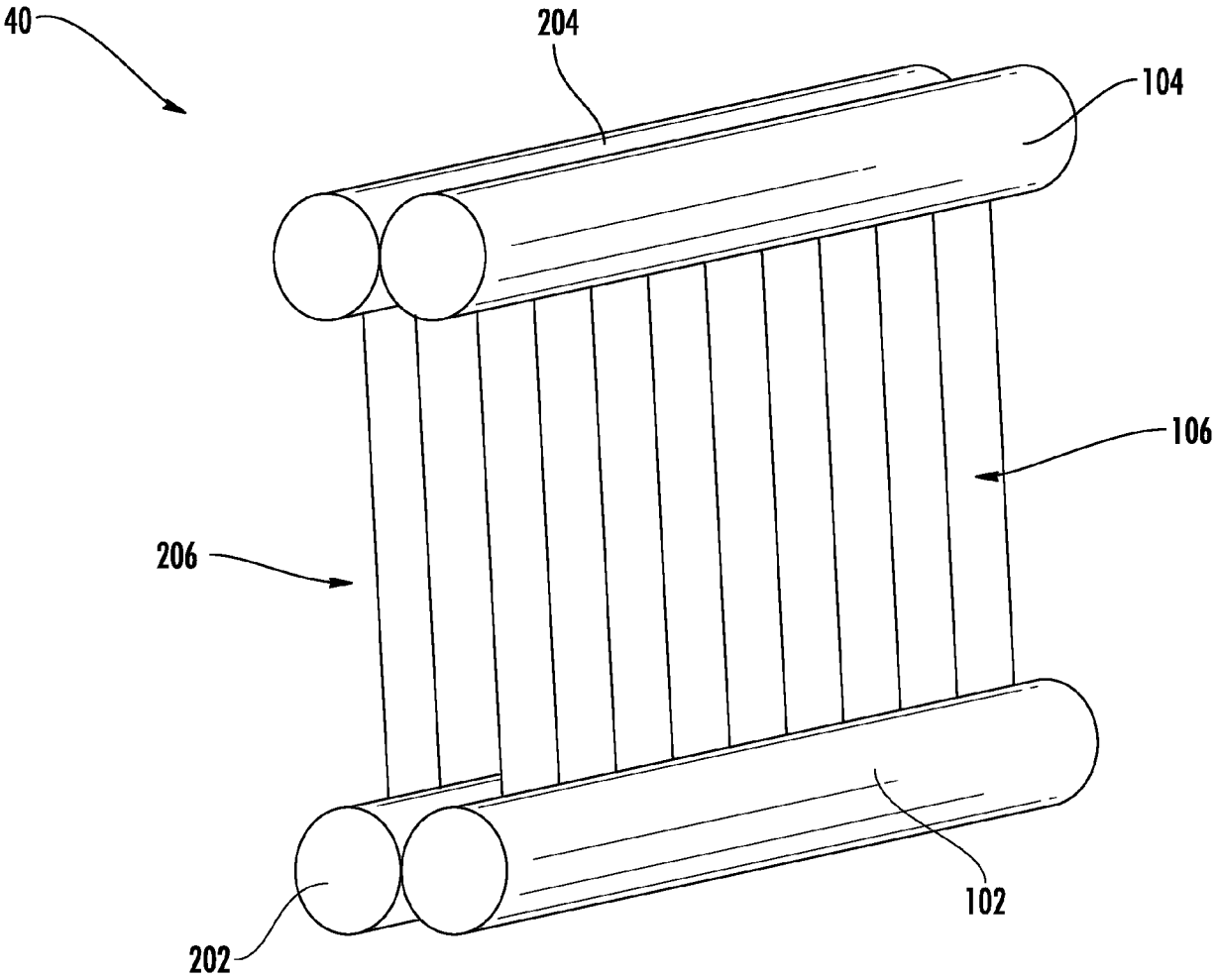
FIG. 2 is a perspective view of a multibank microchannel heat exchanger according to an embodiment of the invention.

A basic refrigeration system 20 is illustrated in FIG. 1 including a compressor 22 compressing a refrigerant and delivering it downstream to a condenser (or gas cooler) 24. From the condenser 24, the refrigerant passes through an expansion device 26 into a fluid conduit 28 leading into an evaporator 30. From the evaporator 30, the refrigerant is returned to the compressor 22 to complete the closed loop refrigeration system 20.

Referring now to the embodiments illustrated in FIGS. 2-9, the evaporator 30 is a multiple bank microchannel heat exchanger 40. However, other types of heat exchangers, such as round tube and plate fin heat exchangers for example, are within the scope of the invention. As depicted, the microchannel heat exchanger 40 includes a first tube bank 100 and a second tube bank 200, the second tube bank 200 being disposed behind the first tube bank 100 that is downstream with respect to an airflow A through the heat exchanger 40. In other embodiments, the second tube bank 200 may be arranged generally upstream with respect to the airflow A.

Figure 3:
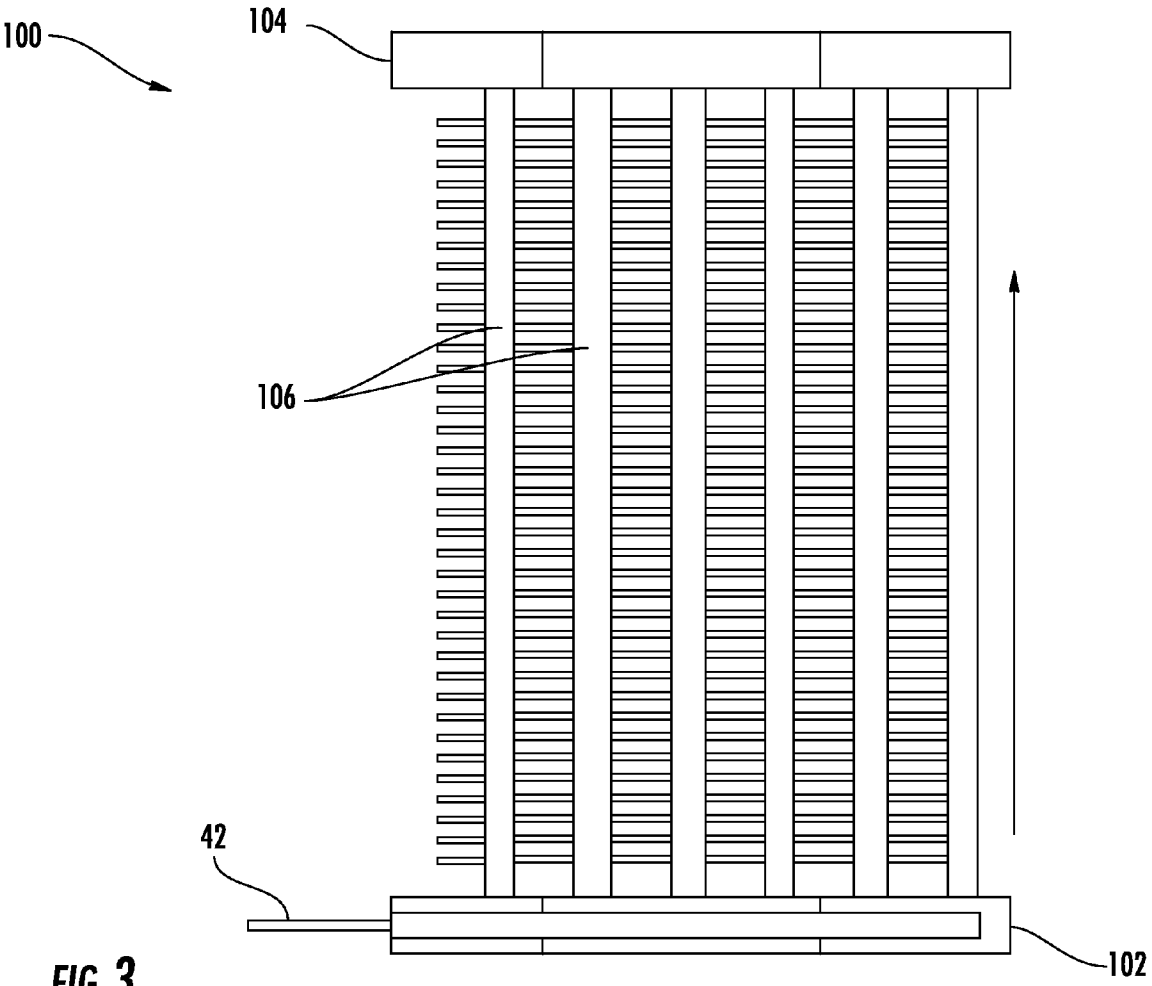
FIG. 3 is a cross-sectional view of a first tube bank of the multibank microchannel heat exchanger according to an embodiment of the invention.
Figure 4:
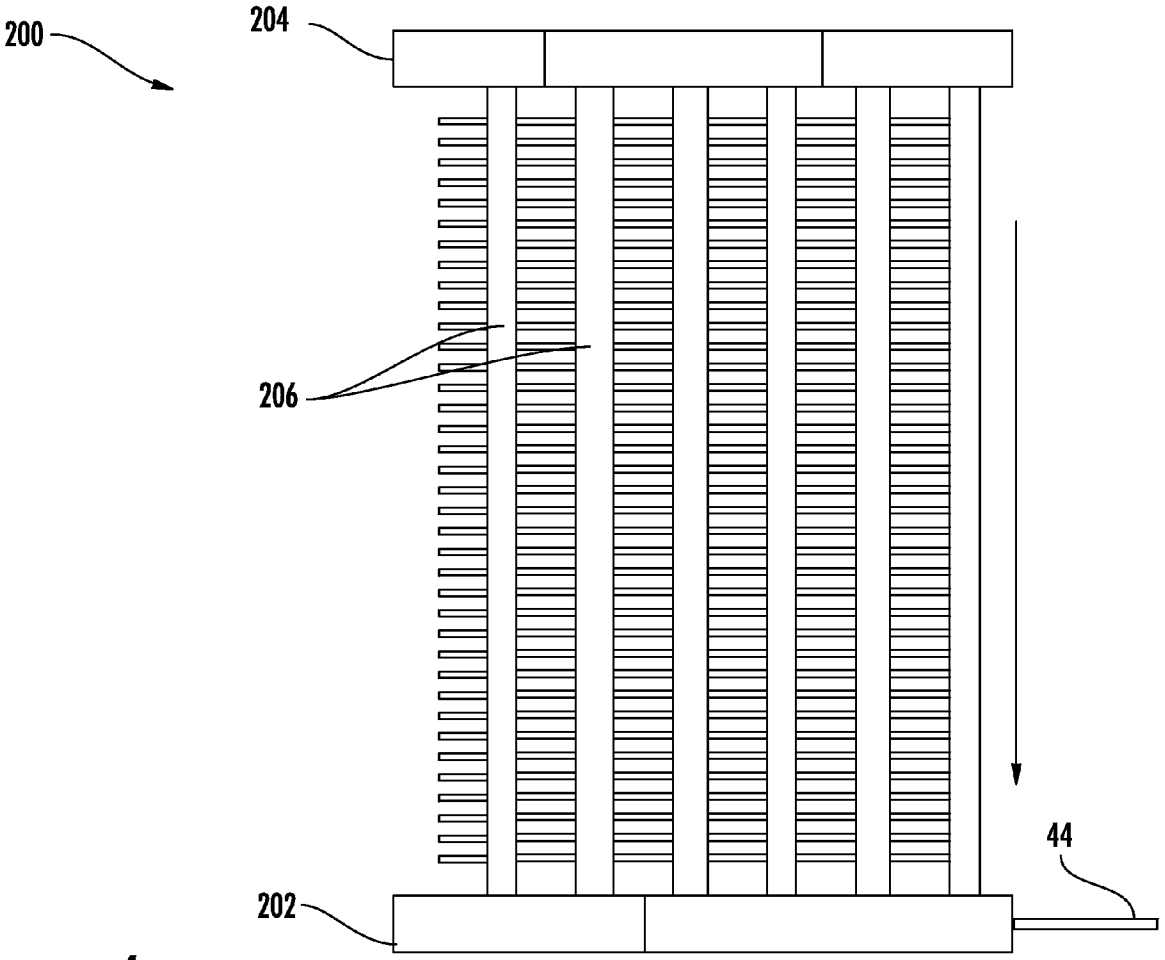
FIG. 4 is a cross-sectional view of a second tube bank of the multibank microchannel heat exchanger according to an embodiment of the invention.

The first tube bank 100, shown in detail in FIG. 3, includes a first manifold 102, a second manifold 104 spaced apart from the first manifold 102, and a plurality of first heat exchanger tubes 106 extending generally in spaced, parallel relationship between and connecting the first manifold 102 and the second manifold 104 in fluid communication. In the illustrated, non-limiting embodiment, the plurality of first heat exchange tubes 106 are shown arranged in parallel relationship extending generally vertically between a generally horizontally extending first manifold 102 second manifold 104. The second tube bank 200, shown in FIG. 4, similarly includes a first manifold 202, a second manifold 204 spaced apart from the first manifold 202, and a plurality of second heat exchange tubes 206 extending in spaced parallel relationship between and connecting the first manifold 202 and the second manifold 204 in fluid communication. In the illustrated, non-limiting embodiment, the plurality of second heat exchange tubes 206 are arranged in a parallel relationship extending generally vertically between a horizontally extending first manifold 202 and second manifold 204. It should be understood that other orientations of the heat exchange tubes and respective manifolds are within the scope of the invention. Furthermore, bent heat exchange tubes and bent manifolds for the first tube bank 100 and the second tube bank 200 are also within the scope of the invention.

In the embodiment shown in the FIGS., the manifolds 102, 104, 202, 204 comprise longitudinally elongated, generally hollow, closed end cylinders having a circular cross-section. However, manifolds 102, 104, 202, 204 having other configurations, such as a semi-circular, semi-elliptical, square, rectangular, or other cross-section for example, are within the scope of the invention. Each set of manifolds 102, 202, 104, 204 disposed at either side of the dual bank heat exchanger 40 may comprise separate paired manifolds or may comprise separate portions within an integrally fabricated manifold.

Figure 5:
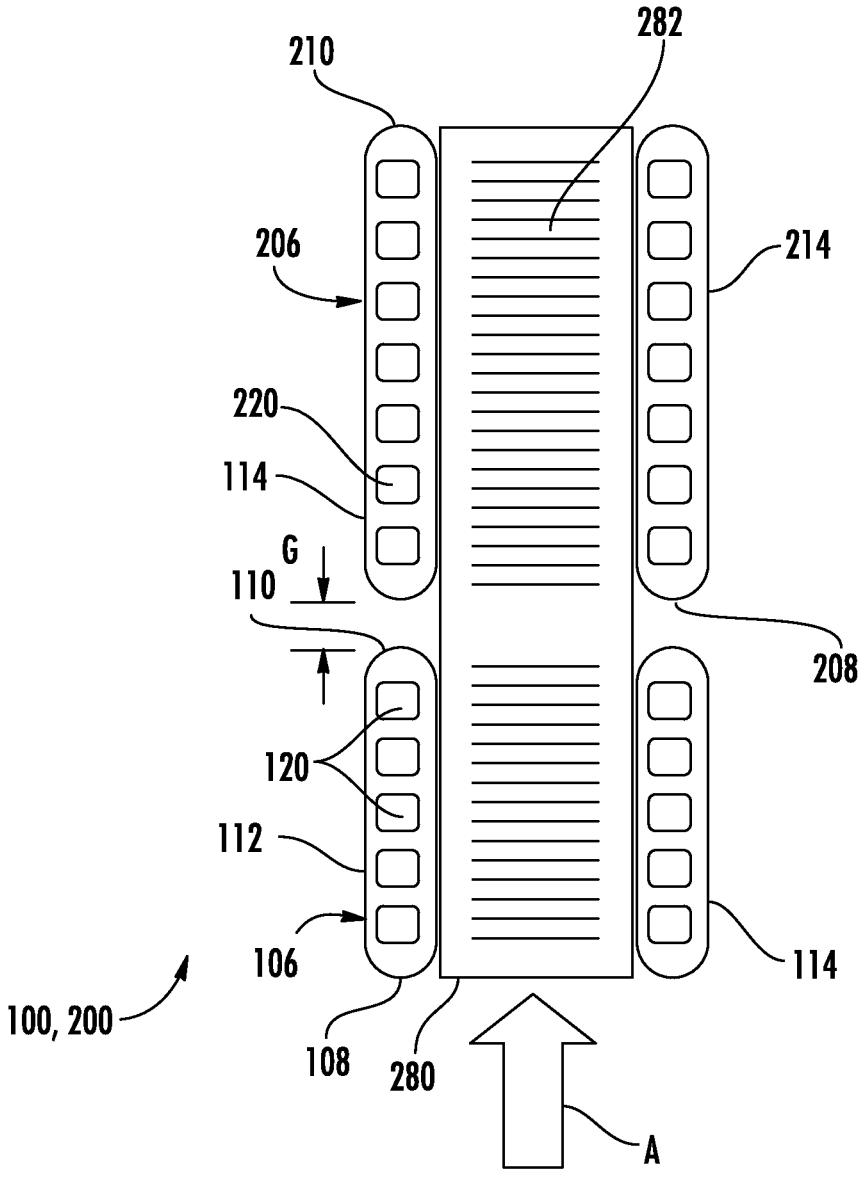
FIG. 5 is a cross-sectional view of the heat exchanger tubes of the multibank microchannel heat exchanger according to an embodiment of the invention.

Referring now to FIG. 5, each of the plurality of first heat exchange tubes 106 and second heat exchange tubes 206 includes a flattened heat exchanger tube having a leading edge 108, 208, a trailing edge 110, 210, a first side 112, 212 and a second, opposite side 114, 214. The leading edge 108, 208 of each of the heat exchange tubes 106, 206 is upstream from its respective trailing edge 110, 210 with the respect to the airflow A through the heat exchanger 40. In the illustrated embodiments, the respective leading and trailing portions of the tubes 106, 206 are rounded, thereby providing blunt leading edges 108, 208 and trailing edges 110, 210. However, it is to be understood that the respective leading and trailing portion of the first and second tubes 106, 206 may be formed in other configurations.

The interior flow passage of each of the plurality of first and second heat exchange tubes 106, 206, respectively, may be divided by interior walls into a plurality of discrete flow channels 120, 220 that extend longitudinally from an inlet end to an outlet end of the tubes 106, 206 and establish fluid communication between the respective manifolds 102, 104, 202, 204 of the first and second tube banks 100, 200. In the illustrated, non-limiting embodiment, the heat exchange tubes 106 of the first tube bank 100 and the heat exchange tubes 206 of the second tube bank 200 have different depths i.e. expanse in the direction of the airflow A. However, it is to be understood that the depth of the first heat exchange tubes 106 may be substantially identical to the depth of the second heat exchange tubes 206. Also, the interior flow passage of the heat exchange tubes 106, 206 may be divided into the same number or into a different number of discrete flow channels 120, 220. These flow channels 120, 220 may have a circular cross-section, a rectangular cross-section, or a cross-section of another shape.

The second tube bank 200 is disposed behind the first tube bank 100 such that each second heat exchange tube 206 is directly aligned with a respective first heat exchange tube 106. Alternatively, the second tube bank 200 may be disposed behind the first tube bank 100 such that the second heat exchange tubes 206 are disposed in a staggered configuration relative to the first heat exchange tubes 106. The leading edges 208 of the second heat exchange tubes 206 are spaced from the trailing edges 110 of the first heat exchange tubes 106 by a desired spacing G. In one embodiment, the heat exchange tubes 106, 206 may be connected by a web (not shown), to reduce the assembly complexity of the heat exchanger 40. The web connecting heat exchange tubes 106 and 206 may have cutouts in a longitudinal direction, to prevent heat conduction between heat exchange tubes 106 and 206 and improve condensate drainage.

Each tube bank 100, 200 additionally includes a plurality of folded fins 280 disposed between adjacent tubes 106, 206 of the first and second tube banks 100, 200. Each folded fin may 280 be formed from a single continuous strip of fin material tightly folded, for example in a ribbon-like fashion thereby providing a plurality of closely spaced fins 282 that extend generally orthogonal to the heat exchange tubes 106, 206, as illustrated in FIG. 5. Heat exchange between the refrigerant R flowing through the tubes 106, 206 and the airflow A passing through the fins 280, occurs at the side surfaces 112, 212, 114, 214, respectively of the heat exchange tubes 106, 206, collectively forming the primary heat exchanger surface, and also through the heat exchange surface of the fins 280, collectively forming the secondary heat exchange surface. In the depicted embodiment, the depth of each ribbon like folded fin 280 extends from the leading edge 108 of the first tube bank 100 to the trailing edge 210 of the second tube bank 200. Alternatively, a first folded fin 280 may extend over at least a portion of the depth of each first heat exchange tube 106 and a separate, second folded fin 280 may extend over at least apportion of the depth of each second heat exchange tube 206.

The illustrated heat exchanger 40 has a crossflow arrangement wherein refrigerant from a vapor compression refrigerant system 20, such as illustrated in FIG. 1, passes through the heat exchanger 40 in heat exchange relationship with a cooling media, such as ambient air, flowing through the heat exchanger 40 in the direction indicated by arrow A. The air passes transversely across the sides 112, 114 of the first heat exchange tubes 106 of the first tube bank 100, and then passes transversely across the sides 212, 214 of the second heat exchanger tubes 206 of the second tube bank 200. In the illustrated embodiment, the refrigerant passes first through the tubes 106 of the first tube bank 100 and then through tubes 206 of the second tube bank 200. However, other configurations, such as where the refrigerant is configured to pass through the second tube bank 200 and then through the first tube bank 100 for example, are within the scope of the invention.

In the illustrated embodiments, both the first tube bank 100 and the second tube bank 200 have a single-pass refrigerant configuration. Refrigerant passes from a refrigerant circuit 20 into the first manifold 102 of the first tube bank 100 through at least one refrigerant inlet 42. From the first manifold 102, configured to function as an inlet manifold, the refrigerant passes through the plurality of first heat exchange tubes 106 to the second manifold 104. The refrigerant then passes into the second manifold 204 of the second tube bank 200, fluidly coupled to the second manifold 104 of the first tube bank 100, before flowing through the plurality of second heat exchange tubes 206 to the first manifold 202, where the refrigerant is provided back to the refrigerant circuit 20 via at least one refrigerant outlet 44. The first manifold 202 of the second tube bank 200 is configured to function as an outlet manifold of the heat exchanger 40.

In the illustrated embodiments, the neighboring second manifolds 104, 204 are connected in fluid flow communication such that refrigerant may flow from the interior of the second manifold 104 of the first tube bank 100 into the second manifold 204 of the second tube bank 200. In one embodiment, the first tube bank 100 and the second tube bank 200 may be brazed together to form an integral unit with a single fin 280 spanning both tube banks 100, 200 that facilitate the handling and installation of the heat exchanger 40. However, the first tube bank 100 and the second tube bank 200 may be assembled as separate slabs and then brazed together as a composite heat exchanger 40.

Figure 6:
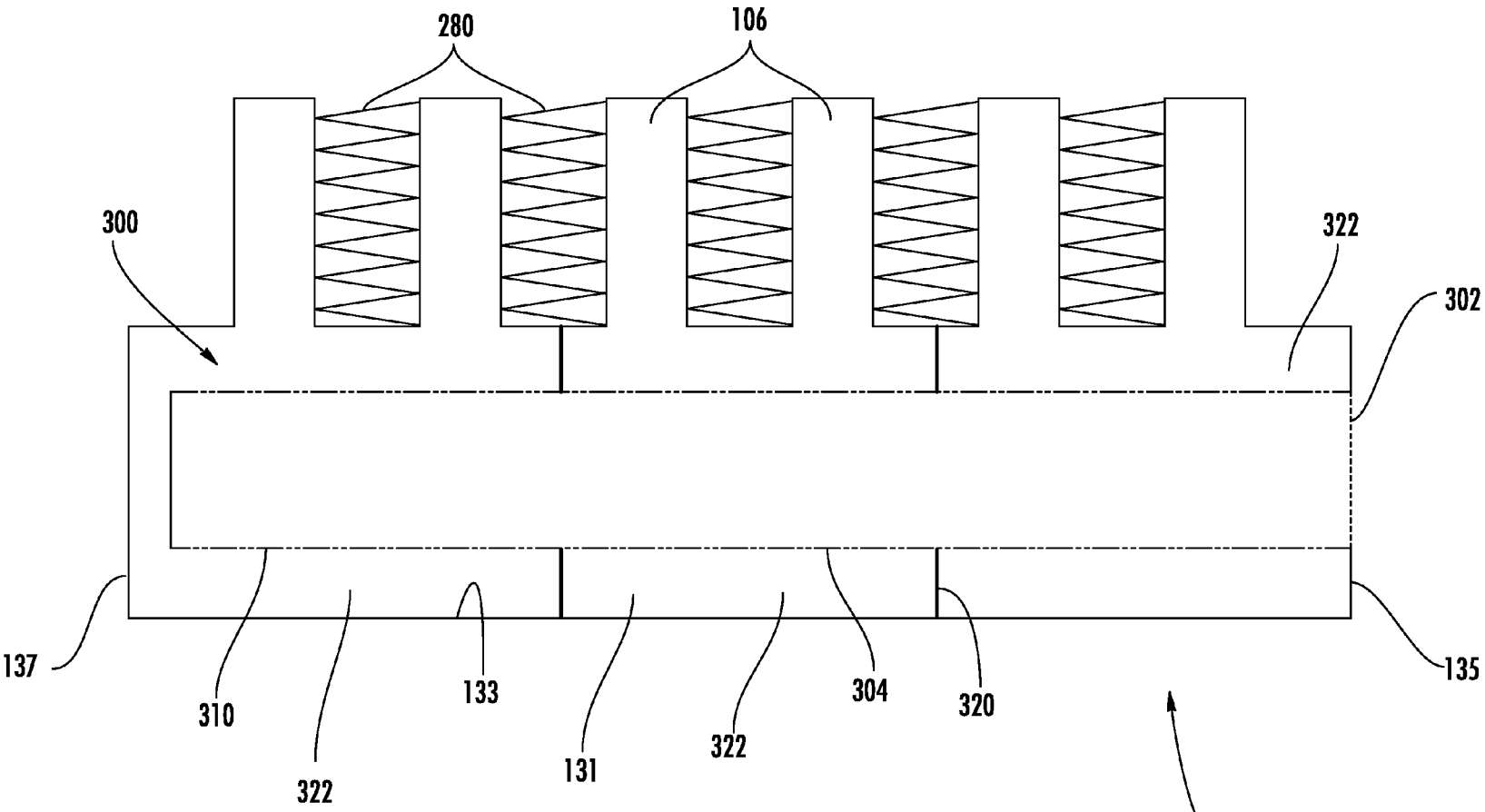
FIG. 6 is a cross-sectional view of a distributor insert arranged within a inlet manifold of the multibank microchannel heat exchanger according to an embodiment of the invention.

Referring now to FIG. 6, a longitudinally elongated distributor insert 300 is arranged generally parallel within the interior volume of the hollow inlet manifold of the heat exchanger 40, such as the first manifold 102 of the first tube bank 100 for example. The distributor insert 300 may have a round, elliptical, rectangular, or other shape cross-section. A first end 302 of the distributor insert 300 is fluidly coupled to the vapor refrigerant circuit 20 (FIG. 1) such that refrigerant from the upstream expansion device 26 is configured to flow directly into the distributor insert 300. The distributor insert 300 extends over at least a portion of the length of the inlet manifold 102. In the illustrated, non-limiting embodiment, the distributor insert 300 extends over a majority of the length of the inlet manifold 102. In one embodiment, the distributor insert 300 is centered within manifold 102, however, embodiments where the insert 300 is off-centered, such as skewed towards the wall of the manifold opposite the heat exchange tubes 106 for example, is also within the scope of the invention.

A plurality of refrigerant distribution orifices 310 are formed in one or more walls 304 of the distributor insert 300 to provide a refrigerant path from an internal cavity 306 of the distributor insert 300 into the hollow interior 131 of the inlet manifold 102. The distribution orifices 310 are small in size and may be any shape such as round, rectangular, oval, or any other shape for example. The distribution orifices 310 may be formed in clusters, or alternatively, may be formed in rows extending longitudinally over the length of the distributor insert 300. In one embodiment, the distribution orifices 310 are arranged about the circumference of the distributor insert 300, such as in an equidistantly spaced configuration for example. Alternatively, the distribution orifices 310 may have a variable spacing over the length of distributor 300 to accommodate the differences in the void fraction of the refrigerant flowing along distributor insert 300.

The distributor insert 300 includes at least one first dividing element 320 located on its periphery and rigidly attached to the outside walls 304 of the distributor insert 300, to the inside walls of the manifold 102 or both. The first dividing elements 320 can be any shape and form, such as flat plates for example, as long as the dividing elements 320 do not block the flow of refrigerant from the distributor insert 300 into the heat exchange tubes 106. In another embodiment, the dividing elements 320 may have cutouts. The dividing elements may be attached to the distributor insert 300 and an interior wall of the manifold mechanically (e.g. snapped into place into small grooves manufactured on the outer wall of the distributor insert 300), or by brazing, welding, or soldering.

When the distributor insert 300 is positioned within the interior volume 131 of the inlet manifold 102, the first dividing elements 320 form a plurality of separate first refrigerant chambers 322 within the inlet manifold 102. Each first chamber 322 is configured to communicate refrigerant downstream to at least one first heat exchanger tube 106 coupled to the inlet manifold 102. Typically, each first refrigerant chamber 322 is fluidly connected to one or more distribution orifices 310 and several heat exchange tubes 106. In one embodiment, each first refrigerant chamber 322 is fluidly coupled to between ten and fifteen first heat exchange tubes 106.

As mentioned previously, a plurality of small refrigerant distribution orifices 310 is configured to direct the refrigerant from the distributor insert 300 into a plurality of first chambers 322 defined by adjacent first dividing elements 320 of the distributor insert 300 within the cavity 131 of the inlet manifold 102. The distance between the first dividing elements 320 may be uniform or can be adjusted to control the size of the first refrigerant chambers 322 associated with any particular group of heat exchanger tubes 106. The distance between the first dividing elements 320 may vary from one cluster of heat exchanger tubes 106 to another, or in an extreme case, from one heat transfer tube 106 to another. The size of the first chambers 322 of the inlet manifold 102 may be uniform along the longitudinal axis of the manifold 102, or for instance, may decrease from the manifold inlet end 135 to its distal end 137, where refrigerant velocity and refrigerant void fraction are expected to be lower. The particular configuration and size of chambers 322 between the first dividing elements 320 could depend on the operational parameters of a particular application.

An outer periphery of the first dividing elements 320 is tightly received within an inner wall 133 of the inlet manifold 102. Similarly, an inner periphery of the first dividing elements 320 is closely received on an outer wall 304 of the insert 300. In this manner adjacent first separation chambers 322 are isolated from each other, preventing refrigerant migration from one first refrigerant chamber 322 to another. Therefore, the overall characteristics of the refrigerant flow into the heat exchanger tubes 106 can be controlled such that the effects of phase separation and/or refrigerant migration can be minimized or eliminated.

The distributor insert 300 receives the two phase refrigerant from the fluid conduit 26 and delivers this refrigerant, through a plurality of small distribution orifices 310 into the heat exchanger inlet manifold 102 that has been divided into a plurality of first chambers 322 by the first dividing elements 320 of the distributor insert 300. A relatively small size of the distributor insert 300 provides significant momentum for the refrigerant flow preventing the phase separation of the two phase refrigerant. The plurality of the distribution orifices 310 uniformly directs the two-phase refrigerant into the plurality of first chambers 322 of the manifold 102 defined by the spaced first dividing elements 320 of the distributor insert 300. Since the size of the first refrigerant chambers 322 is relatively small, the refrigerant liquid and vapor phases do not have conditions and time to separate. The distributor insert 300 with the plurality of distribution orifices 310 and first dividing elements 320 prevents refrigeration maldistribution and assures uniform refrigerant distribution in the heat exchanger tubes 106.

Figure 7:
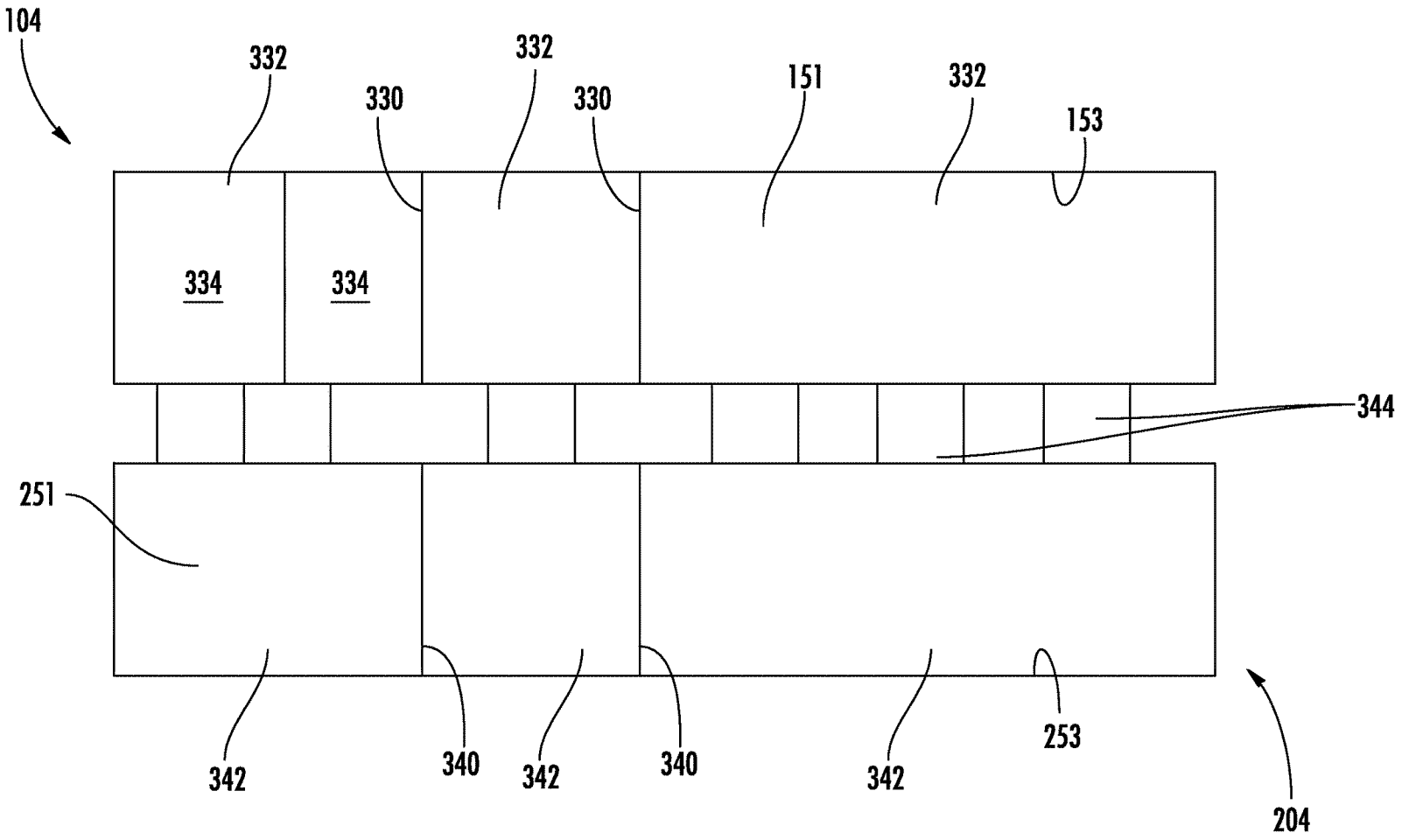
FIG. 7 is a cross-sectional view of an intermediate manifold of the multibank microchannel heat exchanger according to an embodiment of the invention.
Figure 8:
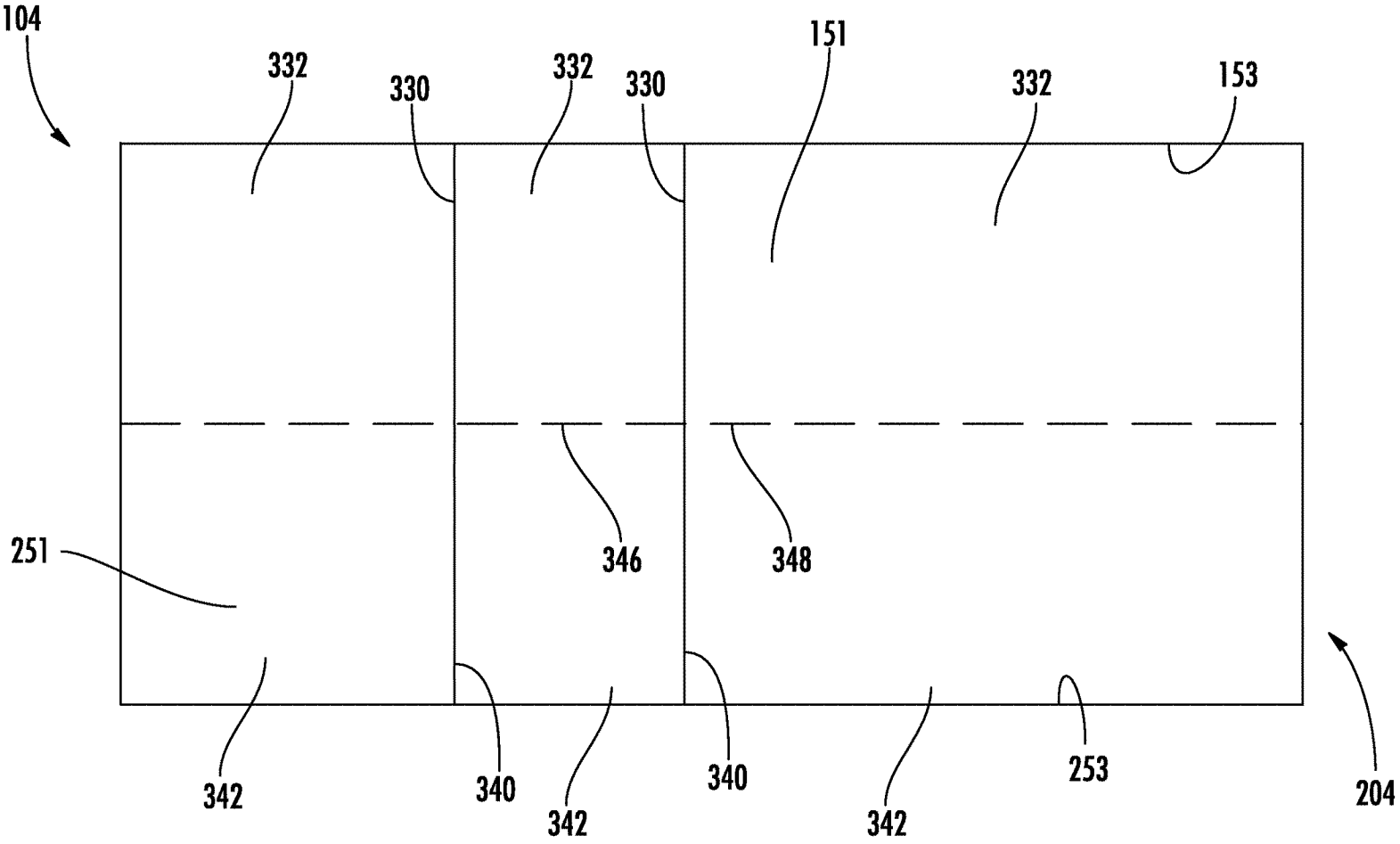
FIG. 8 is a cross-sectional view of another intermediate manifold of the multibank microchannel heat exchanger according to an embodiment of the invention.

Referring now to FIGS. 7 and 8, a plurality of second dividing elements 330 are arranged within the hollow interior volume 151 of an intermediate manifold of the heat exchanger, such as the second manifold 104 of the first tube bank 100 for example. An outer periphery of the second dividing elements is tightly received within an inner wall 153 of the second manifold 104 to form a plurality of separate second refrigerant chambers 332 within second manifold 104. In one embodiment, the second dividing elements 330 are positioned within the internal cavity 151 of the second manifold 104 such that the second refrigerant chambers 332 are substantially identical in size and position to the first refrigerant chambers 322. As a result, each second refrigerant chamber 332 is fluidly coupled to the same first heat exchange tubes 106 as a corresponding first refrigerant chamber 322. Each of the plurality of second refrigerant chambers 332 may be subdivided into one or more sub-chambers 334, each sub-chamber 334 being fluidly coupled to a portion of the first heat exchange tubes 106 connected to a second refrigerant chamber 322. Alternatively, two first refrigerant chambers 322 may be combined into a single second refrigerant chamber 332 by eliminating a dividing element 330 between them.

A plurality of third dividing elements 340 is arranged within the hollow interior volume 251 of another intermediate manifold of the heat exchanger, such as the second manifold 204 of the second tube bank 200 fluidly coupled to the second manifold 104 of the first tube bank 100 for example. An outer periphery of the third dividing elements 340 is tightly received within an inner wall 253 of the second manifold 204 to form a plurality of third refrigerant chambers 342 within the manifold 204. In one embodiment, the third dividing elements 340 are positioned within the internal cavity 251 of the second manifold 204 such that the third refrigerant chambers 342 are substantially identical to the second refrigerant chambers 332. In embodiments where the second manifold 104 of the first tube bank 100 and the second manifold 204 of the second tube bank 200 are formed separately (FIG. 7), each second chamber 332 is fluidly coupled to one of the third chambers 332 by one or more external fluid conduits 344. In embodiments where the second manifolds 104, 204 are integrally formed (FIG. 8), one or more openings 346 may be formed in a wall 348 extending between each corresponding second and third chamber 332, 342 of the manifolds 104, 204. By partitioning the intermediate manifolds 104, 204 in a manner substantially identical to the inlet manifold 102, the refrigerant flow within each chamber 322, 332, 342 does not have an opportunity to be redistributed or cross to other sections of the heat exchanger 40.

Figure 9:
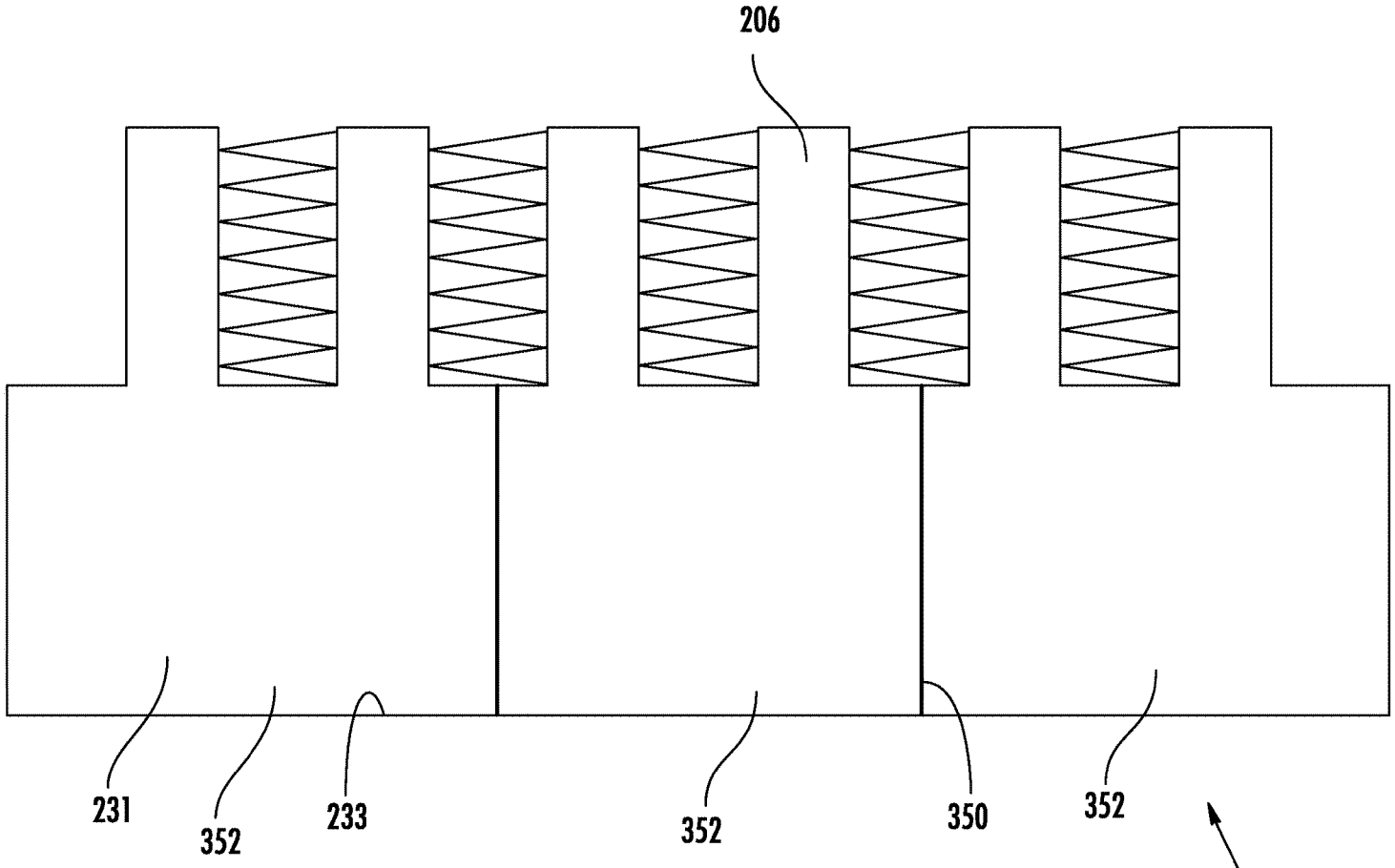
FIG. 9 is a cross-sectional view of an outlet manifold of the multibank microchannel heat exchanger according to an embodiment of the invention.

Referring now to FIG. 9, the outlet manifold does not have require any dividing elements 350, however, inclusion of such dividing elements 350 may improve the overall refrigerant distribution by streamlining the refrigerant outlet conditions. In the illustrated, non-limiting embodiment, one or more fourth dividing elements 350 are arranged within the hollow interior 231 of an outlet manifold of the heat exchanger, such as the first manifold 202 of the second tube bank 200 for example. An outer periphery of the fourth dividing elements 350 is tightly received within an inner wall 233 of the outlet manifold 202 to form a plurality of fourth refrigerant chambers 352 within the internal cavity of the first manifold. The fourth dividing elements 350 may be positioned within the outlet manifold 202 so that the fourth chambers 352 are substantially identical to the first chambers 322 formed in the inlet manifold 102, and the second and third chambers 332, 342 formed in the intermediate manifolds 104, 204. Alternatively, the fourth dividing elements 350 may be arranged at distinct positions such that the heat exchange tubes 206 coupled to one or more of the fourth chambers 352 differs from a corresponding third chamber 342. Each of the plurality of forth refrigerant chambers 352 may be subdivided into one or more sub-chambers, each sub-chamber being fluidly coupled to a portion of the second heat exchange tubes 206 connected to a third refrigerant chamber 342. Alternatively, two third refrigerant chambers 342 may be combined into a fourth refrigerant chamber 352 by eliminating a dividing element 350 between them.

By using a multi-slab microchannel heat exchanger 40 having the distributor insert 300 and plurality of dividing elements 320, 330, 340, 350 as an evaporator 30 in a refrigerant system 20, the air temperature supplied by the refrigeration system is more uniform. Inclusion of the distributor insert and dividing elements improves the refrigerant distribution through the heat exchanger, and additionally reduces manufacturing complexity.

While the present invention has been particularly shown and described with reference to the exemplary embodiments as illustrated in the drawing, it will be recognized by those skilled in the art that various modifications may be made without departing from the spirit and scope of the invention. Therefore, it is intended that the present disclosure not be limited to the particular embodiment(s) disclosed as, but that the disclosure will include all embodiments falling within the scope of the appended claims. In particular, similar principals and ratios may be extended to the rooftops applications and vertical package units.

What is claimed is:

1. A heat exchanger including:

a first tube bank including an inlet manifold and a plurality of first heat exchanger tubes arranged in spaced parallel relationship;

a second tube bank including an outlet manifold and a plurality of second heat exchanger tubes arranged in spaced parallel relationship;

an intermediate manifold configured to fluidly couple the first tube bank and the second tube bank;

a distributor insert arranged within the inlet manifold, the distributor insert including at least one first dividing element configured to define a plurality of first refrigerant chambers within the inlet manifold; and at least one second dividing element arranged within the intermediate manifold and configured to define a plurality of second refrigerant chambers therein, wherein each second dividing element is arranged at a position substantially identical to a corresponding first dividing element such that each second refrigerant chamber is fluidly coupled to the same portion of first heat exchange tubes as a corresponding first refrigerant chamber; and at least one subdividing element arranged within one of the plurality of second refrigerant chambers to subdivide the second refrigerant chamber into a plurality of subchambers, each subchamber being fluidly coupled to only a portion of the first heat exchange tubes connected to the second refrigerant chamber.

2. The heat exchanger according to claim 1, wherein each of the first refrigerant chambers is substantially identical in size.

3. The heat exchanger according to claim 1, wherein the plurality of first refrigerant chambers vary in size.

4. The heat exchanger according to claim 1, wherein the distributor insert includes a plurality of refrigerant distribution orifices configured to provide a refrigerant flow path from an internal cavity of the distributor insert to each of the plurality of first refrigerant chambers.

5. The heat exchanger according to claim 4, wherein the plurality of refrigerant distributor orifices are arranged in clusters over a length of the distributor insert.

6. The heat exchanger according to claim 4, wherein the plurality of refrigerant distributor orifices is arranged in rows arranged about a circumference of the distributor insert.

7. The heat exchanger according to claim 4, wherein the plurality of refrigerant distributor orifices is different for various first refrigerant chambers.

8. The heat exchanger according to claim 1, wherein the intermediate manifold includes a first manifold fluidly coupled to a second manifold.

9. The heat exchanger according to claim 7, wherein the intermediate manifold further comprises at least one third dividing element configured to define a plurality of third refrigerant chambers, the at least one second dividing element being positioned within the first manifold and the at least one third dividing elements being arranged within the second manifold.

10. The heat exchanger according to claim 9, wherein the at least one third dividing element is located at a position within the second manifold substantially identical to a corresponding second dividing element within the first manifold.

11. The heat exchanger according to claim 9, wherein at least one fourth dividing element configured to define a plurality of fourth refrigerant chambers is arranged within the outlet manifold.

12. The heat exchanger according to claim 10, wherein the at least one fourth dividing element is arranged at a position within the outlet manifold substantially identical to a corresponding third dividing element within the second manifold.

13. The heat exchanger according to claim 10, wherein the at least one fourth dividing element is arranged at a position within the outlet manifold different than corresponding third dividing element within the second manifold.

14. The heat exchanger according to claim 1, wherein a plurality of folded fins is positioned between the first heat exchanger tubes of the first tube bank and the second heat exchanger tubes of the second tube bank.

15. A heat exchanger including:

a first tube bank including an inlet manifold and a plurality of first heat exchanger tubes arranged in spaced parallel relationship;

a second tube bank including an outlet manifold and a plurality of second heat exchanger tubes arranged in spaced parallel relationship;

an intermediate manifold configured to fluidly couple the first tube bank and the second tube bank;

a distributor insert arranged within the inlet manifold, the distributor insert including at least one first dividing element configured to define a plurality of first refrigerant chambers within the inlet manifold; and at least one second dividing element arranged within the intermediate manifold and configured to define a plurality of second refrigerant chambers therein, wherein at least one each second dividing element is arranged at a position offset from a corresponding first dividing element such that a portion of first heat exchanger tubes in communication with a second refrigerant chamber are different than a portion of first heat exchange tubes fluidly coupled to a corresponding first refrigerant chamber.

* * * * *